United States Patent [19]

Pratt et al.

[11] 4,175,519

[45] Nov. 27, 1979

[54] VAPOR GENERATOR UTILIZING VERTICAL BARS FOR SUPPORTING ANGULARLY ARRANGED FURNACE BOUNDARY WALL FLUID FLOW TUBES

[75] Inventors: Harry H. Pratt, West Orange; Dudley P. Money, Parsippany, both of N.J.

[73] Assignee: Foster Wheeler Energy Corporation, Livingston, N.J.

[21] Appl. No.: 892,061

[22] Filed: Mar. 31, 1978

[51] Int. Cl.[2] ..... F22B 37/24

[52] U.S. Cl. ..... 122/510; 122/6 A

[58] Field of Search ..... 122/6 A, 235 A, 406 S, 122/510

[56] References Cited

U.S. PATENT DOCUMENTS

| | | | |
|---|---|---|---|
| 3,295,504 | 1/1967 | Engler | 122/510 |
| 3,298,360 | 1/1967 | Michel | 122/510 |
| 3,400,689 | 9/1968 | Bagley et al. | 122/510 |
| 3,744,458 | 7/1973 | Bruckner et al. | 122/235 |
| 3,832,979 | 9/1974 | Ammann | 122/6 |
| 4,063,534 | 12/1977 | Kral | 122/510 |
| 4,123,994 | 11/1978 | Gersch et al. | 122/6 |

OTHER PUBLICATIONS

"Modern German Boiler Practice" by German Water Tube Boiler Makers Assn. dated Jul. 1964.

*Primary Examiner*—Kenneth W. Sprague
*Attorney, Agent, or Firm*—Marvin A. Naigur; John J. Herguth, Jr.; John E. Wilson

[57] ABSTRACT

A vapor generator including an upright furnace section the boundary walls of which are formed by a plurality of tubes, a portion of which extend at an angle with respect to a horizontal plane. Fluid is passed through the length of the furnace section to convert a portion of the fluid to vapor or to heat the fluid. A plurality of vertical bars are provided which define support surfaces for the tubes and which are welded to the tubes for supporting same.

10 Claims, 5 Drawing Figures

VAPOR GENERATOR UTILIZING VERTICAL BARS FOR SUPPORTING ANGULARLY ARRANGED FURNACE BOUNDARY WALL FLUID FLOW TUBES

BACKGROUND OF THE INVENTION

This invention relates to a vapor generator and, more particularly, to a sub-critical or super-critical once-through vapor generator system for converting water to vapor.

In general, a once-through vapor generator operates to circulate a pressurized fluid, usually water, through a vapor generating section and a superheating section to convert the water to vapor. In these arrangements, the water entering the unit makes a single pass through the circuitry and discharges through the superheating section outlet of the unit as superheated vapor for use in driving a turbine, or the like.

These arrangements provide several improvements over conventional drum-type boilers, and, although some problems arose in connection with early versions of the once-through generators, such as excessive thermal loses, mismatching of steam temperature, the requirement for sophisticated controls and additional valving during startup, these problems have been virtually eliminated in later generation systems.

For example, the system disclosed in U.S. Pat. No. 4,099,384 issued on July 11, 1978, and assigned to the assignee of the present invention, includes a plurality of separators disposed in the main flow line between the vapor generating section and the superheating section and adapted to receive fluid flow from the vapor generating section during startup and full load operation of the system. This arrangement enables a quick and efficient startup to be achieved with a minimum of control functions, and without the need for costly valves. Also, the turbines can be smoothly loaded at optimum pressures and temperatures that can be constantly and gradually increased, without the need of boiler division valves or external bypass circuitry for steam dumping. Also, according to this system operations can be continuous at very low loads with a minimum of heat loss to the condenser.

In the latter arrangement, the walls of the furnace section of the generator are formed by a plurality of vertically extending tubes having fins extending outwardly from diametrically opposed portions thereof, with the fins of adjacent tubes being connected together to form a gas-tight structure. During startup the furnace operates at constant pressure and super-critical water is passed through the furnace boundary walls in multiple passes to gradually increase its temperature. This requires the use of headers between the multiple passes to mix out heat unbalances caused by portions of the vertically extending tubes being closer to the burners than others or by the tubes receiving uneven absorption because of local slag coverage, burners being out of service, and other causes. The use of these intermediate headers, in addition to being expensive, makes it undesirable to operate the furnace at variable pressure because of probability of separation of the vapor and liquid phases within the header and uneven distribution to the down-stream circuit. Therefore, this type of arrangement requires a pressure reducing station interposed between the furnace outlet and the separators to reduce the pressure to predetermined values and, in addition, requires a relatively large number of downcomers to connect the various passes formed by the furnace boundary wall circuitry.

In U.S. application Ser. No. 791,830, now U.S. Pat. No. 4,116,168 filed on Apr. 28, 1977 and assigned to the same assignee as the present invention, a vapor generator is disclosed which incorporates the features of the system discussed above and yet eliminates the need for intermediate headers, additional downcomers, and a pressure reducing station. These improvements are achieved at least in part by forming the boundary walls of the furnace section of the vapor generator by a plurality of interconnected tubes a portion of which extend at an acute angle with respect to a horizontal plane. According to a preferred embodiment of this arrangement, the boundary walls defining the upper and lower portions of the furnace section of the vapor generator extend vertically while the tubes in the intermediate furnace portion extend at an acute angle with respect to a horizontal plane. The latter tubes are in fluid flow registry with the tubes in the lower and upper furnace portions, and wrap around the furnace section for at least one revolution.

This use of angularly extending tubes in the intermediate furnace section enables the fluid to average out furnace heat imbalances and be passed through the boundary walls in one complete pass thus eliminating the use of multiple passes and their associated mix headers and downcomers. As a result, the furnace can be operated at variable pressure and the need for a pressure reducing station is eliminated. Also as a result of the angularly extending tubes, a relatively high mass flow rate together with a large tube size is possible compared to a vertical tube arrangement.

However, although the use of the angularly extending tubes has apparent advantages, there is a problem associated with their use. In particular, in a typical vertical tube arrangement, the gravity loads on the furnace walls formed by the tubes results in negligible bending stress in the tubes. However, when the tubes are disposed at an angle, i.e., with their longitudinal axis at an angle to the vertical, a component of gravity load perpendicular to the longitudinal axis is introduced, which causes bending moments in the tube wall and, if not relieved, could result in failure of the wall.

SUMMARY OF THE INVENTION

It is therefore, an object of the present invention to provide a vapor generator which incorporates the features of the arrangements discussed above and yet eliminates the need for intermediate headers, additional downcomers, and a pressure reducing station.

It is a further object of the present invention to provide a vapor generator of the above type in which the boundary walls of the furnace section of the vapor generator are formed by a plurality of interconnected tubes, a portion of which extend at an acute angle with respect to a horizontal plane.

It is a further object of the present invention to provide a vapor generator of the above type in which a plurality of vertically extending bars are disposed at spaced intervals across the boundary walls and are connected to the tubes for supporting the tubes and relieving any bending moments that occur.

It is a still further object of the present invention to provide a vapor generator of the above type in which the support bars define support surfaces in supporting engagement with the tubes.

It is a still further object of the present invention to provide a vapor generator of the above type in which the fluid passes through the boundary wall circuitry of the furnace section in one single complete pass.

Towards the fulfillment of these and other objects, the vapor generator of the present invention comprises an upright furnace section the boundary walls of which are formed by a plurality of tubes through which fluid is passed to apply heat to the fluid. One portion of the tubes extend at an acute angle with respect to a horizontal plane and wrap around the furnace section for at least one revolution, and a plurality of substantially vertically extending support bars are disposed at spaced intervals across the boundary walls and are connected to the tubes for supporting same.

BRIEF DESCRIPTION OF THE DRAWINGS

The above brief description, as well as further objects, features, and advantages, of the present invention will be more fully appreciated by reference to the following detailed description of a presently preferred but nonetheless illustrative embodiment in accordance with the present invention, when taken in connection with the accompanying drawings wherein.

DESCRIPTION OF THE PREFERRED EMBODIMENTS

Figure 1:
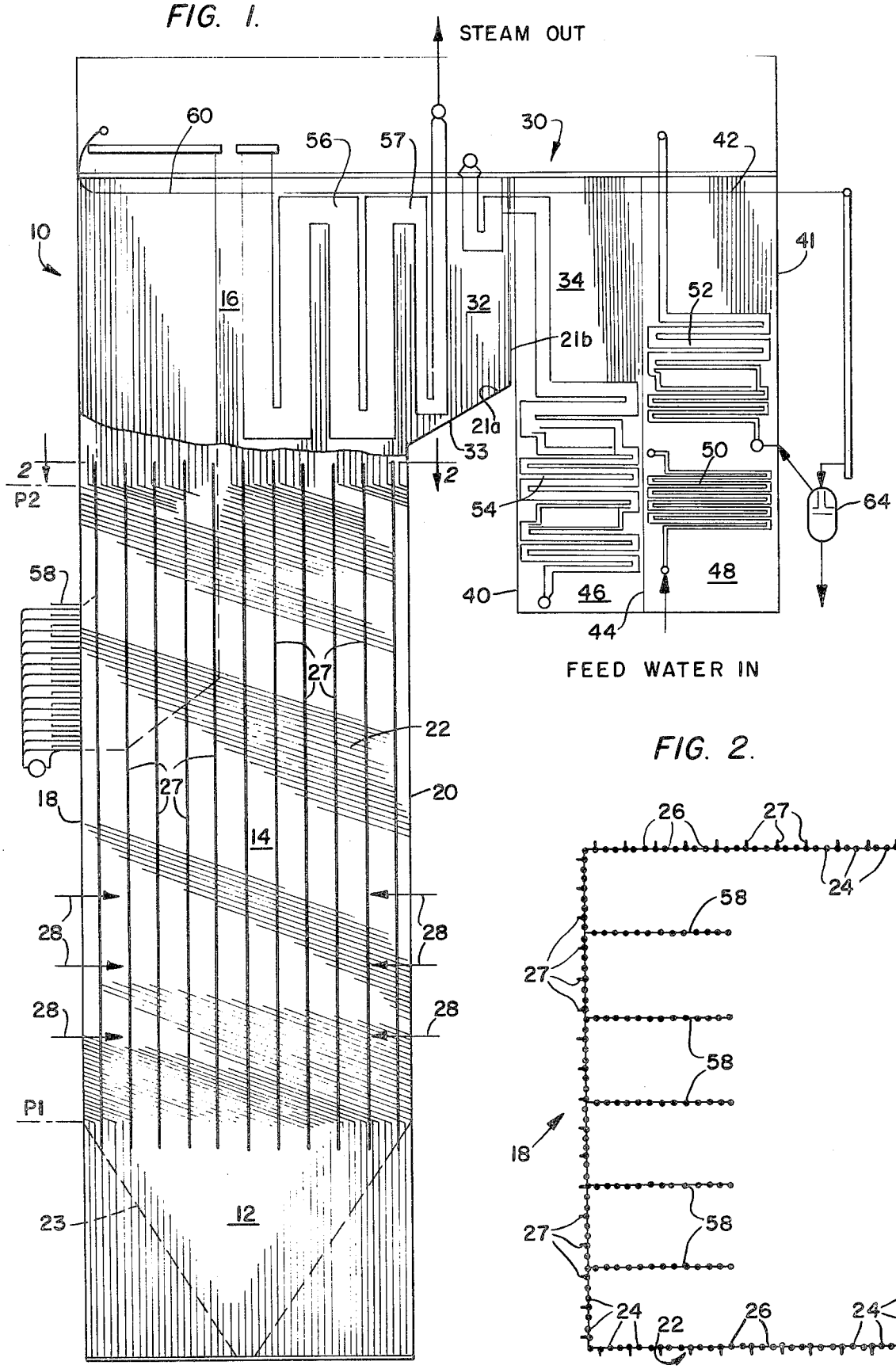
FIG. 1 is a schematic-sectional view of the vapor generator of the present invention.

Referring specifically to FIG. 1 of the drawings, the reference numeral 10 refers in general to the vapor generator of the present invention and includes a lower furnace section 12, an intermediate furnace section 14, and an upper furnace section 16. The boundary walls defining the furnace sections 12, 14, and 16 include a front wall 18, a rear wall 20 and two sidewalls extending between the front and rear walls, with one of said sidewalls being referred to by the reference numeral 22. The lower portions of the front wall 18 and the rear wall 20 are sloped inwardly to form a hopper section 23 at the lower furnace section 12 for the accumulation of ash, and the like, in a conventional manner.

Figure 2:
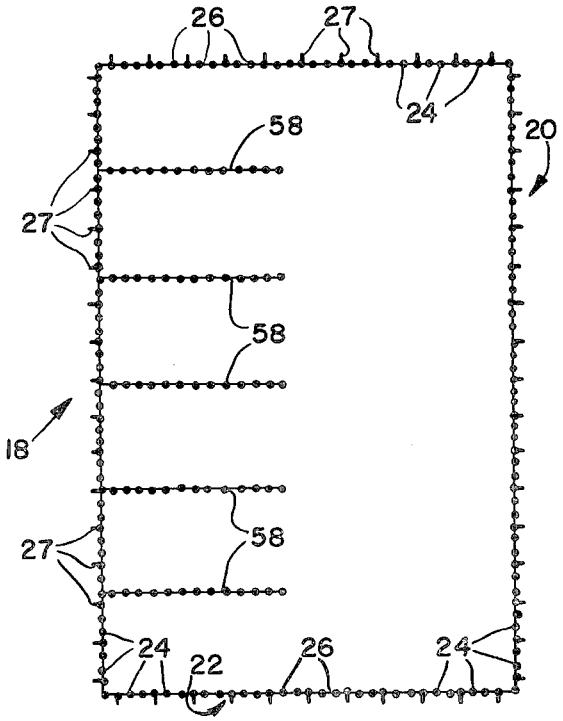
FIG. 2 is a sectional view taken along the line 2—2 of FIG. 1.

As better shown in FIG. 2, each of the walls 18, 20, and 22 are formed of a plurality of tubes 24 having continuous fins 26 extending outwardly from diametrically opposed portions thereof, with the fins of adjacent tubes being connected together in any known manner, such as by welding, to form a gas-tight structure.

Figure 3:
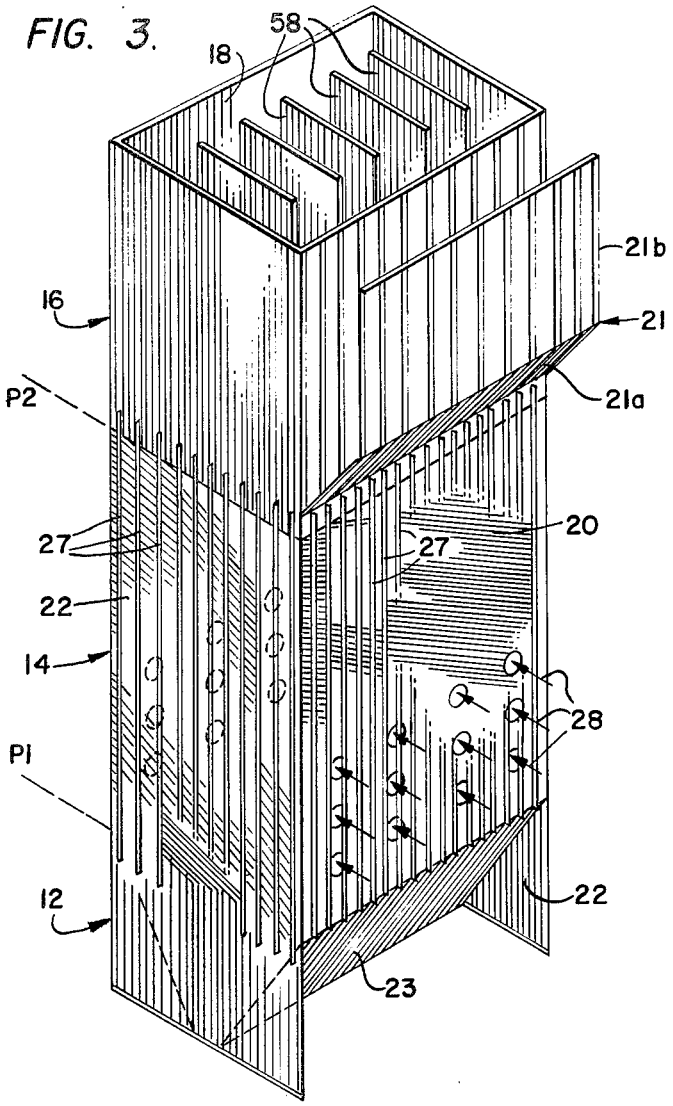
FIG. 3 is a partial perspective view of a portion of the vapor generator of FIG. 1.

Referring specifically to FIGS. 1 and 3, in the lower furnace section 12 the tubes 24 in the sidewalls 22 extend vertically up to a horizontal plane P1 located at the upper portion of the hopper section 23, while the tubes 24 in the front wall 18 and the rear wall 20 are sloped inwardly from the latter plane to form the hopper section 23. The tubes 24 forming the walls 18, 20, and 22 in the intermediate section 14 extend from the plane P1 to a plane P2 disposed in the upper portion of the vapor generator 10, with these tubes extending at an acute angle with respect to the planes P1 and P2. The tubes 24 forming the walls 18, 20, and 22 of the upper furnace section 16 extend vertically from the plane P2 to the top of the latter section with the exception of a portion of the tubes in the rear wall 20 which are bent out of the plane of the latter wall to form a branch wall 21 as will be explained in detail later.

The tubes 24 in the intermediate section 14 extend from plane P1 and wrap around for the complete perimeter of the furnace at least one time to form the corresponding portions of the walls 18, 20, and 22 before they terminate at the plane P2. The tubes 24 in the intermediate section 14 have a plurality of fins 26 which are arranged and which function in an identical manner to the fins of the tubes in the lower furnace section 12 and in the upper furnace section 14.

Although not clear from the drawings, it is understood that each tube 24 in the intermediate furnace section 14 is connected to, and registers with, two tubes 24 in the upper furnace section 16 and with two tubes 24 in the lower furnace section 12, with the connections being made by bifurcates extending between the respective tubes as disclosed in detail in U.S. application Ser. No. 861,388, filed on Dec. 16, 1977, and assigned to the same assignee as the present invention.

As mentioned above, the upper portion of the rear wall 20 in the upper furnace section 16 has a branch wall 21 which consists of an angular portion **21*a* and a vertical portion 21*b* formed by bending a selected number of tubes 24 from the rear wall 20 outwardly to form the angular portion 21*a* and then upwardly to form the vertical portion 21*b*. As a result, spaces are defined between the remaining tubes 24 in the upper portion of the wall 20 as well as between the portions of the tubes forming the vertical portion 21*b* of the branch wall 21. This permits combustion gases to exit from the upper furnace section 16**, as will be described later.

Figure 4:
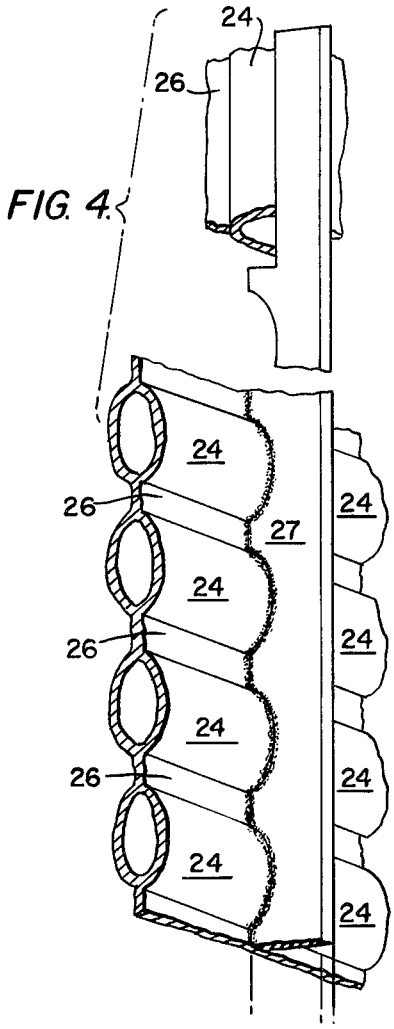
FIG. 4 is an enlarged, partial, elevational view of a portion of a boundary wall of the vapor generator of FIGS. 1–3.

Referring to FIGS. 1, 3, and 4, a plurality of vertically extending support bars 27 are disposed at spaced intervals across the outer surfaces of the boundary walls 18, 20, and 22. Each support bar 27 extends from a point just above plane P2, to a point immediately below plane P1, with the exception that, with respect to the front wall 18 and the rear wall 20, they terminate at plane P1. As better shown in FIG. 4, each bar 27 is milled, or scalloped, to form surfaces corresponding in shape to portions of the outer circumference of the tubes 24. The latter portions of the tubes 24 extend within the corresponding surfaces of the bars 27 and are welded thereto as shown. Since portions of each bar 27 extending in the upper furnace section 16 and along a portion of the sidewalls 22 of the lower furnace section 12 are connected to vertically extending tubes, the support surfaces of these portions of the bars would be milled accordingly as shown in the upper portion of FIG. 4.

The bars 27 can be disposed at predetermined intervals across the width of the walls 18, 20, and 22, such as four feet. Therefore, if the width of the sidewalls 22 is forty-five feet, for example, approximately eleven bars 27 would be disposed across each wall. Also if the front wall 18 and rear wall 20 were each approximately seventy feet in width, then approximately seventeen bars 27 would be disposed along these walls. It is noted that, for the convenience of presentation, the drawings do not disclose the use of insulation material which would normally extend along the outer surfaces of each of the walls 18, 20, and 22 and the bars 27.

A plurality of burners 28 are disposed in the front and rear walls 18 and 20 in the intermediate furnace section 14, with the burners being arranged in this example in three vertical rows of four burners per row. The burners 28 are shown schematically since they can be of a conventional design.

Referring again to FIG. 1, a heat recovery area, shown in general by the reference numeral 30, is provided adjacent the upper furnace section 16 in gas flow communication therewith, and includes a vestibule section 32 and convection section 34. The floor of the vestibule section 32 is shown by the reference numeral 33 and is formed by the angular portion 21*a* of the branch wall 21 with the tubes 24 in this portion being provided with fins which are connected to fins of adjacent tubes to render the floor 33 gas-tight. The remaining portions of the tubes 24 forming the vertical portion 21*b* of the branch wall 21 extend in a spaced relation to permit gases to pass from the vestibule section 32 to the convection section 34.

The convection section 34 includes a front wall 40 the upper portion of which is formed by a plurality of tubes extending in a spaced relationship to permit the gases from the vestibule section to enter the convection section. The heat recovery area 30 also includes a rear wall 41 and two sidewalls 42, with one of the latter being shown in FIG. 1. It is understood that the rear wall 41, the sidewalls 42, and the lower portion of the front wall 40 are formed of a plurality of vertically extending, finned, interconnected tubes 24 in a manner similar to that of the upper furnace section 16.

A partition wall 44, also formed by a plurality of finned, interconnected tubes 24, is provided in the heat recovery area 30 to divide the latter into a front gas pass 46 and a rear gas pass 48. An economizer 50 is disposed in the lower portion of the rear gas pass 48, a primary superheater 52 is disposed immediately above the economizer, and a bank of reheater tubes 54 is provided in the front gas pass 46.

A platen superheater 56 is provided in the upper furnace section 16 and a finishing superheater 57 is provided in the vestibule section 32 in direct fluid communication with the platen superheater 56.

As better shown in FIG. 3, a plurality of division walls 58 are provided with each having a portion disposed adjacent the front wall 18. The division walls 58 penetrate a portion of the tubes 24 of the front wall in the intermediate furnace section 14, and extend upwardly within the upper furnace section 16 as shown in FIG. 1.

The upper end portions of the walls 18, 20, and 22, the branch wall 21, and the division walls 58, as well as the partition wall 44, the sidewalls 42 and the rear wall 41 of the heat recovery area 30 all terminate in substantially the same general area in the upper portion of the vapor generating section 10.

A roof 60 is disposed in the upper portion of the section 10 and consists of a plurality of tubes 24 having fins 26 connected in the manner described above but extending horizontally from the front wall 18 of the furnace section to the rear wall 41 of the heat recovery area 30.

It can be appreciated from the foregoing that combustion gases from the burners 28 in the intermediate furnace section 14 pass upwardly to the upper furnace section 16 and through the heat recovery area 30 before exiting from the front gas pass 46 and the rear gas pass 48. As a result, the hot gases pass over the platen superheater 56, the finishing superheater 57 and the primary superheater 52, as well as the reheater tubes 54 and the economizer 50, to add heat to the fluid flowing through these circuits.

Although not shown in the drawings for clarity of presentation, it is understood that suitable inlet and outlet headers, downcomers and conduits, are provided to place the tubes 24 of each of the aforementioned walls and heat exchangers as well as the roof 60 in fluid communication to establish a flow circuit that will be described in detail later.

A plurality of separators 64 are disposed in a parallel relationship adjacent the rear wall 41 of the heat recovery area 30 are disposed directly in the main flow circuit between the roof 60 and the primary superheater 52. The separators 64 may be identical to those described in the above mentioned patent application Ser. No. 713,313 and operate to separate the fluid from the roof 60 into a liquid and vapor. The vapor from the separators 64 is passed directly to the primary superheater 52 and the liquid is passed to a drain manifold and heat recovery circuitry for further treatment as also disclosed in the above mentioned application.

Figure 5:
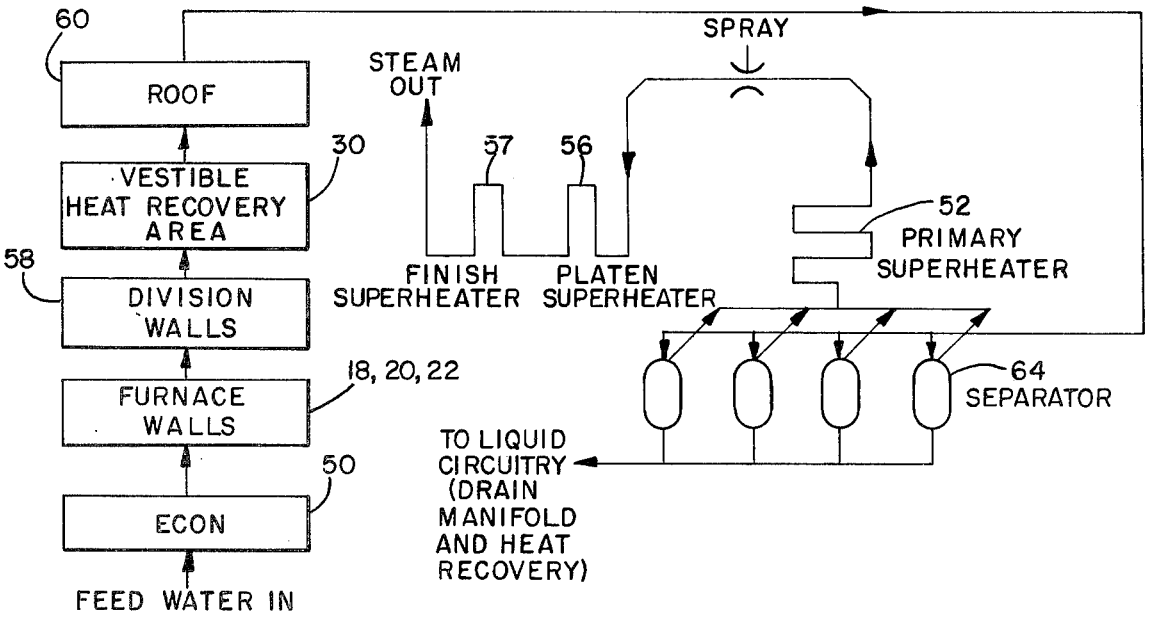
FIG. 5 is a schematic diagram depicting the flow circuit of the vapor generator of FIGS. 1–3.

The fluid circuit including the various components, passes and sections of the vapor generator 10 of FIG. 1 is shown in FIG. 5. In particular, feedwater from an external source is passed through the economizer tubes 50 to raise the temperature of the water before it is passed to inlet headers (not shown) provided at the lower portions of the furnace walls 18, 20, and 22. All of the water flows upwardly and simultaneously through the walls 18, 20, 21, and 22 to raise the temperature of the water further to convert at least a portion of same to vapor, before it is collected in suitable headers located at the upper portion of the vapor generator 10. The fluid is then passed downwardly through a suitable downcomer, or the like, and then upwardly through the division walls 58 to add additional heat to the fluid. The fluid is then directed through the walls 40, 41, 42, and 44 of the heat recovery area 30 after which it is collected and passed through the roof 60. From the roof 60, the fluid is passed via a suitable collection headers, or the like, to the separators 64 which separate the vapor portion of the fluid from the liquid portion thereof. The liquid portion is passed from the separators to a drain manifold and heat recovery circuitry (not shown) for further treatment and the vapor portion of the fluid in the separators 64 is passed directly into the primary superheater 52. From the latter, the fluid is spray attemperated after which it is passed to the platen superheater 56 and the finishing superheater 57 before it is passed in a dry vapor state to a turbine or the like.

Several advantages result from the foregoing. For example, the use of the angularly extending tubes 24 which wrap around to form the intermediate furnace section 14 enables the fluid to average out furnace heat unbalances and be passed through the boundary walls 18, 20, and 22 of the furnace section in one complete pass, thus eliminating the use of multiple passes and their associated mix headers and downcomers. Also, as a result of the angularly extending tubes 24, the furnace section can operate at a variable pressure without the need for a pressure reducing station and a relatively high mass flow rate and large tube size can be utilized over that possible with vertical tube arrangements. Further, the support bars 27 relieve the angularly extending tubes 24 forming the boundary walls of the intermediate furnace section 14 of vertical loads and thus relieve any bending moments in the walls. The support bars 27 can also act as convenient members to transmit internal or external gas pressures on the furnace from the fluid tubes 24 to a conventional external buckstay system.

It is understood that while the preferred embodiment described above includes a furnace having a substantially rectangular shaped cross-sectional area, other cross-sectional configurations, such as those having a circular or elliptical pattern may be utilized as long as the angular tube arrangement is maintained. For example, the furnace may have a helical configuration in a pattern conforming to the cross-sectional shape of the furnace. (In this context, it should be noted that the type of boiler covered by the present invention in which the tubes are angularly arranged in the furnace boundary wall is commonly referred to by those skilled in the art as a "helical tube boiler," notwithstanding the fact that a true mathematical helix is not generated in a boiler which has a substantially rectangular cross-sectional area.) It is also understood that the tubes may wrap around the furnace for more than one complete revolution, depending on the overall physical dimensions of the furnace.

It is further understood that portions of the vapor generator have been omitted for the convenience of presentation. For example, insulation and support systems can be provided that extend around the boundary walls of the vapor generator as discussed above and a windbox or the like may be provided around the burners 28 to supply air to same in a conventional manner. It is also understood that the upper end portions of the tubes 24 forming the upper furnace section 16 and heat recovery area 30 can be hung from a location above the vapor generating section 10 to accommodate thermal expansion in a conventional manner.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. A vapor generator comprising an upright furnace section the boundary walls of which are formed by a plurality of tubes, and means for passing fluid through said tubes to apply heat to said fluid; one portion of each of said walls being formed by tubes extending at an acute angle with respect to a horizontal plane and another portion of each of said walls being formed by tubes extending substantially vertically, and a plurality of substantially vertically extending support bars disposed at spaced intervals across said boundary walls and connected along their lengths to said tubes along both portions of said walls for supporting said tubes, the portion of each support bar connected to said angularly extending tubes having a series of substantially semi-circular notches formed therein for receiving a plurality of said latter tubes and the portion of each support bar connected to said vertically extending tubes having an elongated notch formed therein for receiving one of said latter tubes.

2. The vapor generator of claim 1, wherein said other portion of each of said walls extends in the upper and lower portions of said furnace section and said one portion of each of said walls extends in the intermediate portion of said furnace section.

3. The vapor generator of claim 1, wherein each support bar extends from the upper furnace section portion, through the entire intermediate furnace section and to the lower furnace section portion.

4. The vapor generator of claim 1, wherein said tubes have fins extending outwardly from diametrically opposed portions thereof, with the fins of adjacent tubes being welded together to form a gas-tight structure.

5. The vapor generator of claim 1, wherein all of said fluid is passed simultaneously through the tubes of all of said boundary walls.

6. The vapor generator of claim 1, wherein said furnace section has a rectangular horizontal cross-section.

7. The vapor generator of claim 1, further comprising a superheating section, fluid separating means, and fluid flow circuitry connecting said fluid separating means in a series flow relation between said furnace section and said superheating section.

8. The vapor generator of claim 7, wherein said fluid separating section receives fluid from said vapor generating section during start-up and full load operation of said system and separates said fluid into a liquid and a vapor, said fluid flow circuitry passing the vapor from said separating section to said superheating section during start-up and full load operation of said system.

9. The vapor generator of claim 1, wherein said one portion of tubes wrap around the furnace section for at least one revolution.

10. The vapor generator of claim 1, wherein said bars are welded to said tubes.

* * * * *